US005809588A

United States Patent [19]

Angelotti

[11] Patent Number: 5,809,588

[45] Date of Patent: Sep. 22, 1998

[54] COLLAPSIBLE BABY TUB

[76] Inventor: Christopher Angelotti, 316 Westmont Ave., Haddon Township, N.J. 08108

[21] Appl. No.: 799,042

[22] Filed: Feb. 10, 1997

Related U.S. Application Data

[60] Provisional application No. 60/029,137 Oct. 21, 1996.

[51] Int. Cl. [6] ..... A47K 3/164

[52] U.S. Cl. ..... 4/587; 4/572.1

[58] Field of Search ..... 4/572.1, 586, 587, 4/551, 554, 559, 578.1, 579, 539, 546, 553, 585, 547, 548, 549, 550, 571.1, 573.1, 574.1, 575.1

[56] References Cited

U.S. PATENT DOCUMENTS

| | | | |
|---|---|---|---|
| D. 289,319 | 4/1987 | Kujawski et al. . | |
| D. 350,598 | 9/1994 | Wise et al. . | |
| 1,422,718 | 7/1922 | Keehn . | |
| 1,501,833 | 7/1924 | Amsel | 4/586 X |
| 1,734,462 | 11/1929 | Gottlieb . | |
| 2,460,308 | 2/1949 | Pribil . | |
| 2,698,948 | 1/1955 | Levitt . | |
| 3,319,265 | 5/1967 | Losada . | |
| 3,799,228 | 3/1974 | Crawford | 4/587 |
| 3,882,553 | 5/1975 | Poiencot . | |
| 4,602,394 | 7/1986 | Allen et al. . | |
| 5,181,284 | 1/1993 | Raphael et al. . | |
| 5,249,316 | 10/1993 | Macchiavello . | |
| 5,317,765 | 6/1994 | Knoedler et al. . | |
| 5,361,430 | 11/1994 | Wise . | |
| 5,388,286 | 2/1995 | Davenport . | |
| 5,425,149 | 6/1995 | Crossley et al. . | |
| 5,491,850 | 2/1996 | Kiester . | |

FOREIGN PATENT DOCUMENTS

| | | | |
|---|---|---|---|
| 0673554 | 5/1939 | Germany | 4/572.1 |
| 0828436 | 7/1949 | Germany | 4/557 |
| 0382400 | 11/1964 | Switzerland | 4/579 |
| 2053673 | 2/1981 | United Kingdom . | |
| 2193887 | 8/1987 | United Kingdom . | |

*Primary Examiner*—Charles E. Phillips
*Attorney, Agent, or Firm*—Richard C. Litman

[57] ABSTRACT

A collapsible baby tub for attachment to a conventional bath or its surround. The baby tub includes a generally rectangular sheet, made of a flexible material that is impervious to water, for example, a vinyl, a plasticized material or a rubberized fabric. Support structures brace the sheet within the conventional bathtub. The supporting means include nylon cords and rods; a swivelling suction cup assembly or bracket hooks are used to fasten the rods onto the bathtub or its surround. Two embodiments of the rod fasteners are disclosed.

20 Claims, 3 Drawing Sheets

COLLAPSIBLE BABY TUB

CROSS-REFERENCE TO RELATED APPLICATION

This application claims the benefit of U.S. provisional patent application Ser. No. 60/029,137, filed Oct. 21, 1996.

BACKGROUND OF THE INVENTION

1. Field of the Invention

The present invention relates to a collapsible baby bathtub. More specifically, the invention relates to a collapsible baby bathtub which is attachable to a conventional bathtub.

2. Description of Prior Art

The bathing of babies requires a great deal of care and attention not only to clean and rinse, but also to constantly hold and stabilize them so they do not fall or slip. A number of technicians in the art have attempted in the past to design safe and convenient devices which may be used by the mother in the bathtub.

U.S. Pat. No. 1,422,718, issued on Jul. 11, 1922 to Keehn, discloses a sustaining means for an infant's bathtub. The tub includes two support members which are attachable to a common bathtub. U.S. Pat. No. 1,734,462, issued on Nov. 5, 1929 to Gottlieb, discloses an infant's bathtub which is mounted within a bathtub. U.S. Pat. No. 2,460,308, issued on Feb. 1, 1949 to Pribil, discloses a device for supporting an infant within a conventional bathtub. U.S. Pat. No. 2,698,948, issued on Jan. 11, 1996 to Levitt, discloses a folding bathtub for infants to be supported on the top of a conventional bathtub.

U.S. Pat. No. 3,319,265, issued on May 16, 1967 to Losada, discloses a collapsible baby bathtub made of a waterproof cloth. U.S. Pat. No. 3,882,553, issued on May 13, 1975 to Poiencot, discloses an infant safety bathtub for quickly dumping the water from an upper chamber into a lower chamber. U.S. Pat. No. 4,602,394, issued on Jul. 29, 1986 to Allen et al., discloses a baby bather adapted for attaching to a kitchen sink. U.S. Pat. No. 5,181,284, issued on Jan. 26, 1993 to Raphael et al., discloses an adjustable infant bathtub which can have a variety of adjustments for height.

U.S. Pat. No. 5,249,316, issued on Oct. 5, 1993 to Macchiavello, discloses a bathtub divider having a seat portion formed in front of the divider portion with the front of the divider portion forming a backrest. U.S. Pat. No. 5,317,765, issued on Jun. 7, 1994 to Knoedler et al., discloses a collapsible infant bath ring which may be collapsed to a compact configuration for storage. U.S. Pat. No. 5,361,430, issued on Nov. 8, 1994 to Wise, discloses a baby bathtub having a hammock-like sling suspended in the tub. U.S. Pat. No. 5,388,286, issued on Feb. 14, 1995 to Davenport, discloses an infant bath seat device wherein a seat flap and side walls are pivotally connected to a back wall, such that the seat flap and side walls may be folded in against the back wall in a collapsed configuration for storage. U.S. Pat. No. 5,425,149, issued on Jun. 20, 1995 to Crossley et al., discloses a fold-up baby bathtub wherein the headrest and leg rest are pivotally connected to the base.

U.S. Pat. No. 5,491,850, issued on Feb. 20, 1996 to Kiester, discloses a foldable bathtub-mounted infant support system having a flexible support panel and includes three support rods, each rod having a suction cup at its ends for attaching on to the top edge of a bathtub. U.S. Pat. Nos. Des. 289,319, issued on Apr. 14, 1987 to Kujawski et al., and Des. 350,598, issued on Sep. 13, 1994 to Wise et al., show ornamental designs for an infant bathtub. Finally, Great Britain Patent Nos. 2,053,673, published on Feb. 11, 1981, and 2,193,887, published on Feb. 24, 1988, teach free-standing infant tubs.

None of the above patents disclose the specific collapsible baby tub arrangement which is attachable to a conventional bathtub. In contrast to the prior art, the baby tub of the instant invention is constructed of a flexible, rectangular vinyl panel. Two adjustable support rods are attached to two ends of the flexible panel by means of nylon cords and the rods have means such as suction cups and/or hooks for fastening the baby tub to the bathtub.

None of the above inventions and patents, taken either singularly or in combination, is seen to describe the instant invention as claimed.

SUMMARY OF THE INVENTION

The present invention relates to a collapsible baby tub which is attachable to a conventional bathtub or shower and its surround. The baby tub includes a generally rectangular sheet configured as a basin, made of a flexible material that is impervious to water, for example, a vinyl, a plasticized material or a rubberized fabric. Support structures brace the basin within the conventional bathtub. The supporting means include nylon cords and length-adjustable rods; a swivelling suction cup assembly or bracket hooks are used to fasten the rods onto the bathtub, shower, or its surround.

Accordingly, the principle object of the invention is to provide a collapsible baby tub which is attachable to a conventional bathtub or shower and its surround.

Still another object of the invention is to provide a baby tub which includes a basin, for bathing a subject within a conventional bathtub, constructed of a flexible, constructed of a generally rectangular panel or sheet.

Yet another object is to provide a tub that can fit into a conventional tub, resulting in a savings in the amount of water used.

It is still another object of the invention to provide an baby tub which has two adjustable support rods that are attached to two sides of the flexible panel and which rods have removable suction cups or hooks for fastening the baby tub to the bathtub or shower.

It is yet another object of the invention to provide a simple device, easily stored and easily cleaned in which to bathe a subject.

Another object of the invention is to provide a device which minimizes the need for constant vigilance against the possibility that the baby will slip or fall in a conventional bathtub.

It is an object of the invention to provide improved elements and arrangements thereof in a collapsible baby tub for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
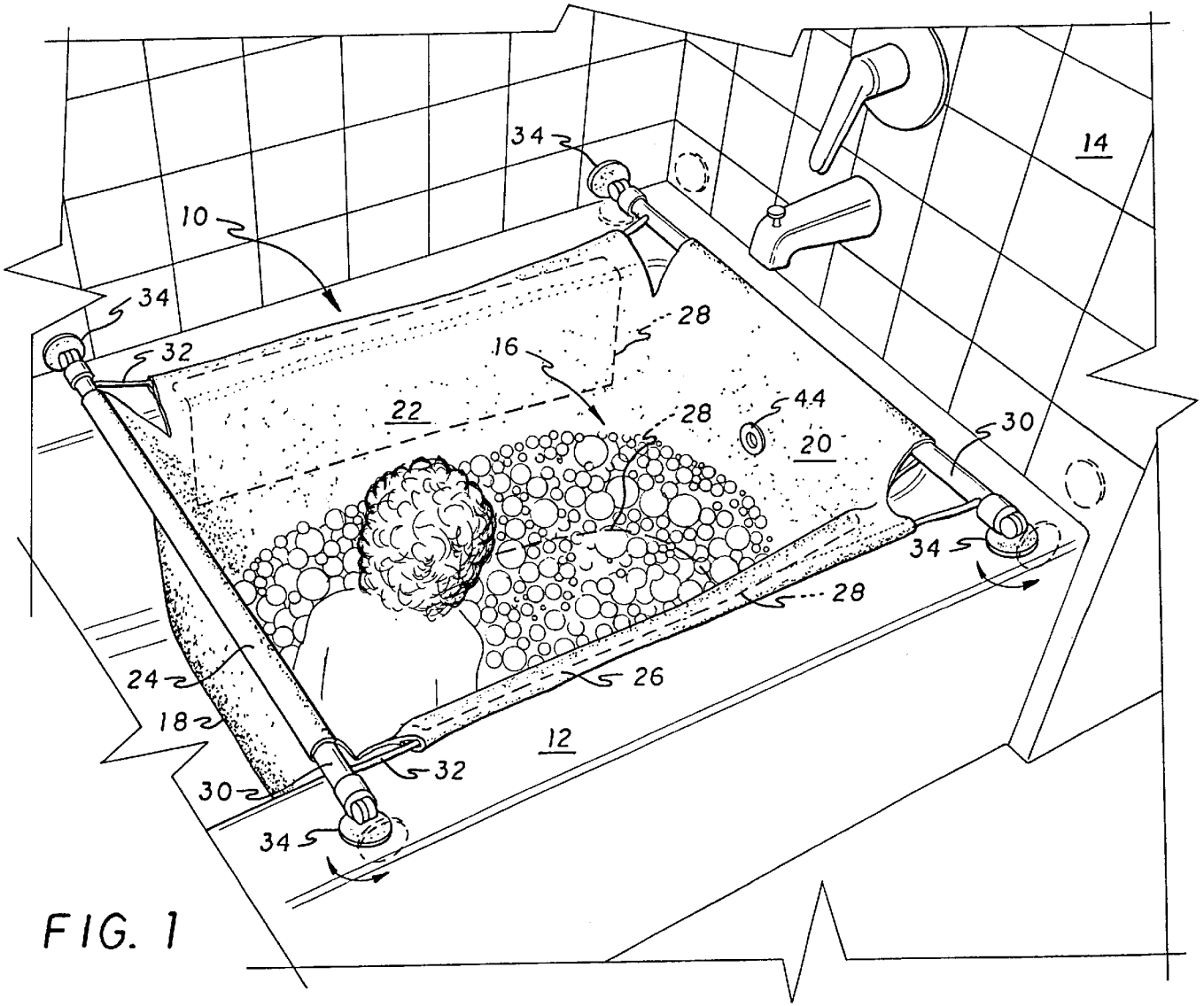
FIG. 1 is an environmental, perspective view of a collapsible baby tub, showing the first embodiment of the rod fasteners, according to the present invention.
Figure 2:
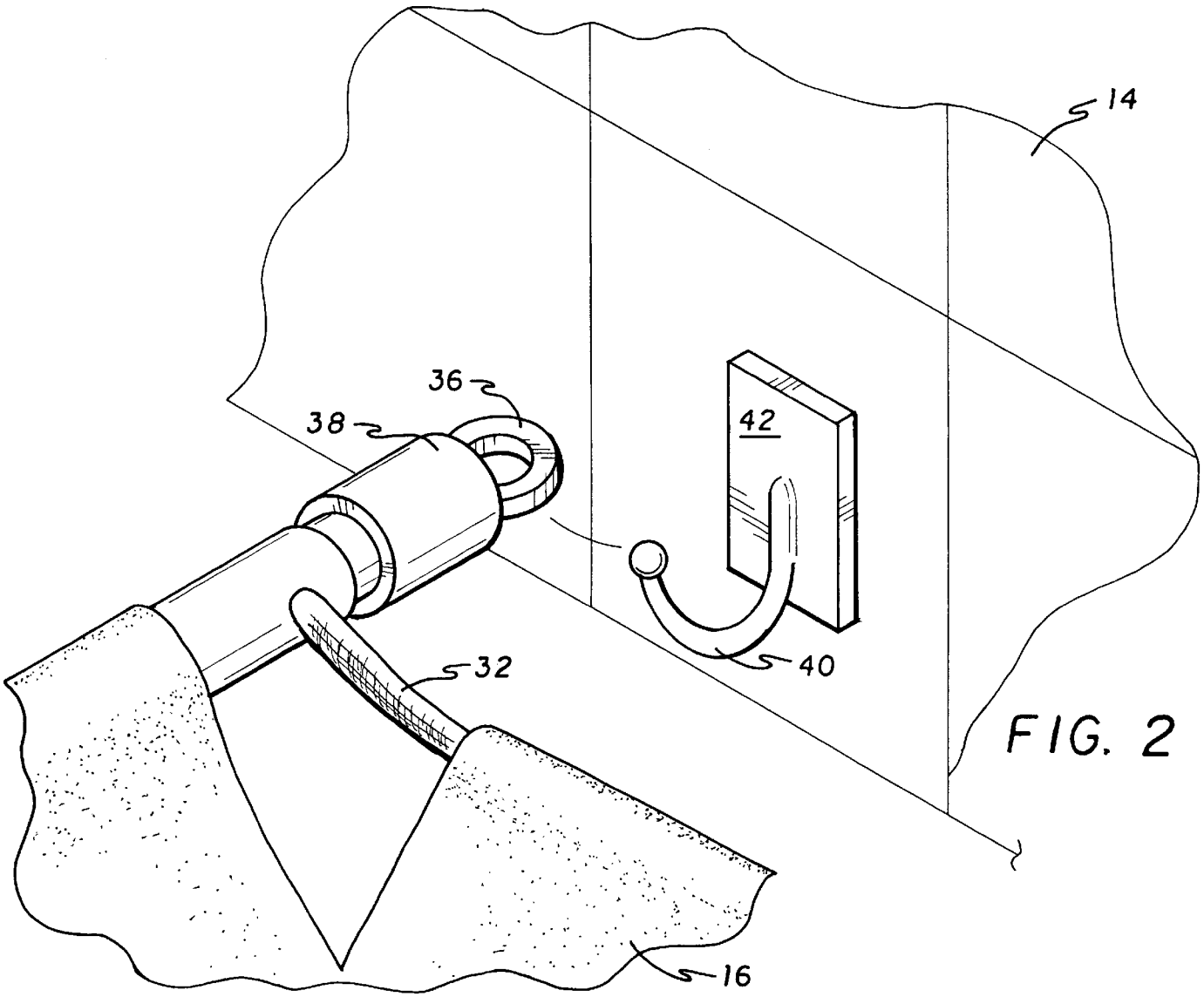
FIG. 2 is an enlarged, cut-away view of the second embodiment of the rod fasteners.
Figure 3:
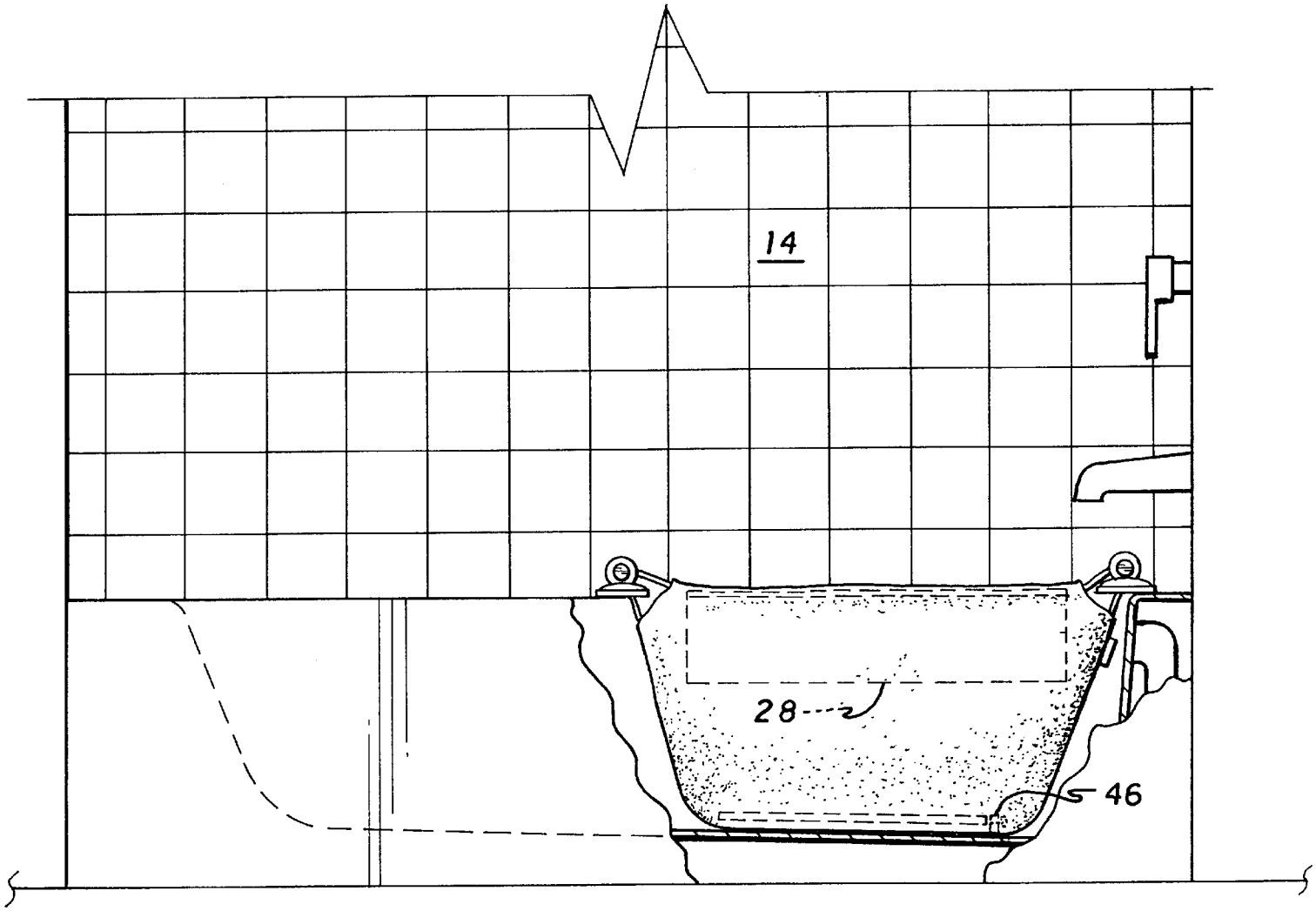
FIG. 3 is a fragmentary side elevational view of the first embodiment of the invention.

In its broadest aspect, the present invention relates to a collapsible baby tub which is attachable to a conventional bathtub or shower. The baby tub is constructed of a flexible, generally rectangular sheet configured as a basin for collecting water. The sheet is made of a flexible material that is impervious to water, such as vinyl, a plastic material or rubberized fabric. Means for supporting the basin, including nylon cords and rods, are attached to the flexible sheet such that the basin can be located within the confines of a conventional bathtub. Means for attaching the supporting means to a bathtub or shower and its surround preferably include suction cups and bracket hooks. FIGS. 1 and 3 both include views of a first embodiment on the means for attaching the baby tub to a bathtub and its surround; FIG. 2 shows a second embodiment of such attaching means.

Referring specifically to FIG. 1, there is illustrated a collapsible baby tub 10 for attachment to a bathtub and its traditional surround. The bathtub and surround is shown having a standard top edge 12 adjacent to a wall 14 of a bathroom.

The baby tub 10 includes a substantially rectangular-shaped waterproof flexible sheet 16, which has a depressed area for holding bath water therein, thereby forming a basin for collection of bath water and a bathed subject. The flexible sheet 16 is preferably made of a flexible vinyl material, a rubberized fabric material, or the like. The sheet 16 comprising the basin has a bottom 18, a pair of first sidewalls 20 opposed to each other and a pair of second sidewalls 22 opposed to each other. Each of the first and second sidewalls 20, 22 extend upwardly from the bottom 18. The bottom 18 and the second sidewalls 22 may be padded by padding 28 to further protect a baby from the walls and bottom of the bathtub in which the baby tub 10 is placed. Each of the extended ends of the first sidewalls 20 terminate in an elongated first sleeve member 24, and each of the extended ends of the second sidewalls 22 terminate in an elongated second sleeve member 26.

The basin so formed by the sheet 16 is supported by a frame including a telescopic rod 30, shown inserted within each of the first sleeve members 24 of the first sidewalls 20. Connecting each of the telescopic rods to one another, a cord 32 extends through each second sleeve member 26 to serve as a support for each of the pair of second sidewalls 22. The flexible cords allow the baby tub 10 to be collapsed for storage by folding or bringing rods 30 together.

To attach the frame so formed to the bathtub and its surround, attaching means include suction cup members 34 attached to the ends of the rods 30. The suction cups 34 are adapted to be affixed on the continuous top edge 12 of the bathtub or positioned on the wall 14 surrounding the bathtub. The suction cups 34 are attached to pivoting assembly (not numbered), such as a ball and socket assembly, which can be swiveled and rotated, allowing the flexibility to position the baby tub 10 between non-opposing surfaces, i.e. on either the continuous edge 12 or an adjacent wall 14.

In contrast and as seen in FIG. 2, a second embodiment of the attaching means provides a loop member 36 attached to a collar 38 which is slipped over rod 30, and, a substantially U-shaped hook member 40 and bracket 42 affixed to the wall 14 of the bathroom such that the hook is turned upward. The loop member 36 can thus be removably passed over the hook member 40 to fasten the rods 30 to the wall 14. It is noted that the hook can be located on any of the walls 14 adjacent the bathtub or that the hook can be on the rods 30 and the loop on the wall 14. Moreover, any combination of hooks or suction cups can be provided on a rod 30.

Finally, the baby tub 16 has an overflow hole 44 (seen in FIG. 1) which is positioned in one of the sidewalls 20 or 22, to prevent inadvertent overflow of bath water held by the basin. A drain hole and plug 46 (as seen in FIG. 3) is provided for convenient emptying of water from the basin.

It is to be understood that the present invention is not limited to the embodiments described above, but encompasses any and all embodiments within the scope of the following claims.

I claim:

1. A collapsible baby tub comprising:

a substantially rectangular-shaped waterproof flexible sheet having a depressed area for holding bath water therein, said depressed area having a bottom, a pair of opposed first sidewalls and a pair of opposed second sidewalls, each of said first and second sidewalls extending upwardly from said bottom and terminating in an elongated sleeve member;

a rod within each of said sleeve members of said first sidewalls, each said rod having a first end and a second end;

a cord within each of said sleeve members of said second sidewalls, each said cord having a first end attached to one rod and a second end attached to the other rod so as to provide support for said second sidewalls; and, means attached to said first and second ends of each said rod for attaching each said rod to a flat surface.

2. The collapsible baby tub as defined in claim 1 wherein said flexible sheet is made of a flexible vinyl material.

3. The collapsible baby tub as defined in claim 1 wherein said flexible sheet is made of a rubberized fabric material.

4. The Collapsible baby tub as defined in claim 1 wherein said means attached to said first and second ends of each said rod includes a suction cup.

5. The collapsible baby tub as defined in claim 4 wherein said means attached to said first and second ends of each said rod further include means for pivoting said suction cup.

6. The collapsible baby tub as defined in claim 1 wherein said means attached to said first and seconds end of each said rod includes one of a hook and a loop attached to said first and second ends of each said rod and the other of a hook or loop attached to a wall.

7. The collapsible baby tub as defined in claim 1 and further including an overflow hole positioned in one of said first and second sidewalls.

8. The collapsible baby tub as defined in claim 1, further including a drain hole and a drain plug for insertion within said drain hole.

9. The collapsible baby tub as defined in claim 1, wherein each said cord is comprised of nylon.

10. The collapsible baby tub of claim 1, further comprising padding in said depressed area.

11. A collapsible baby tub comprising:

a substantially rectangular-shaped waterproof flexible sheet having a depressed area for holding bath water therein, said depressed area having a bottom, a pair of opposed first sidewalls and a pair of opposed second sidewalls, each of said first and second sidewalls, extending upwardly from said bottom and terminating in an elongated sleeve member;

a telescopic rod within each of said sleeve members of said first sidewalls, each said rod having a first end and a second end and being adjustable along its length;

a cord within each of said sleeve members of said second sidewalls, each said cord having a first end and a second end;

a suction cup attached to said first end of each said rod for attachment of each said rod to a continuous top edge of a bathtub; and, means attached to said second end of each said rod for attachment of each said rod to a wall or a continuous edge of a bathtub.

12. The collapsible baby tub as defined in claim 11 wherein said flexible sheet is made of a flexible vinyl material.

13. The collapsible baby tub as defined in claim 11 wherein said flexible sheet is made of a rubberized fabric material.

14. The collapsible baby tub as defined in claim 11 wherein said means attached to said second end of each said rod includes a suction cup.

15. The collapsible baby tub as defined in claim 14 wherein said means attached to said first and second ends of each said rod further include means for pivoting said suction cup.

16. The collapsible baby tub as defined in claim 11 wherein said means attached to said second end of each said rod includes one of a hook and a loop attached to said second end of each said rod and the other of a hook or loop attached to a wall.

17. The collapsible baby tub as defined in claim 11 and further including an overflow hole positioned in one of said first and second sidewalls.

18. The collapsible baby tub as defined in claim 11, further including a drain hole and a drain plug for inserting within said drain hole.

19. The collapsible baby tub as defined in claim 11, wherein each said cord is comprised of nylon.

20. The collapsible baby tub of claim 11, further comprising padding in said depressed area.

* * * * *